US010820713B2

(12) United States Patent
deVilleneuve

(10) Patent No.: US 10,820,713 B2
(45) Date of Patent: Nov. 3, 2020

(54) GATHER-FITTED BEDDING PLACEMENT APPARATUS AND METHOD

(71) Applicant: Anne Guedry deVilleneuve, Metairie, LA (US)

(72) Inventor: Anne Guedry deVilleneuve, Metairie, LA (US)

( * ) Notice: Subject to any disclaimer, the term of this patent is extended or adjusted under 35 U.S.C. 154(b) by 236 days.

(21) Appl. No.: 15/907,502

(22) Filed: Feb. 28, 2018

(65) Prior Publication Data

US 2019/0261779 A1 Aug. 29, 2019

(51) Int. Cl.
*A47C 21/02* (2006.01)
*A47G 9/04* (2006.01)

(52) U.S. Cl.
CPC ..... *A47C 21/022* (2013.01); *A47C 21/028* (2013.01); *A47G 9/04* (2013.01)

(58) Field of Classification Search
CPC ..... A47C 21/022; A47C 21/028; A47G 9/04
See application file for complete search history.

(56) References Cited

U.S. PATENT DOCUMENTS 4,539,723 A * 9/1985 Hillsberry ..... A47C 27/085 24/72.5
4,833,744 A 5/1989 Correa
(Continued)

*Primary Examiner* — David R Hare
*Assistant Examiner* — Adam C Ortiz
(74) *Attorney, Agent, or Firm* — Keaty Law Firm LLC

(57) ABSTRACT

A gather-fitted bedding placement apparatus and method for easy installation and removal, and prevention of slippage during use, of gather-fitted bedding upon a bed mattress. The apparatus has a semi-flexible friction-calibrated sheet-material unit of a size corresponding to the standard minimum depth of the bed mattress, a bottom lip formed along the bottom edge of the semi-flexible friction-calibrated sheet-material unit, at least one curve-enabling notch in the central portion of the bottom lip, to enable bending of the semi-flexible friction-calibrated sheet-material unit to conform to the corner of the mattress, a bottom-lip curved-corner portion formed by such bending, and at least one tab cutout through the semi-flexible friction-calibrated sheet-material unit. The method is practiced by using a gather-fitted bedding placement apparatus at each corner of the mattress, placing the bent semi-flexible friction-calibrated sheet-material unit underneath and inside of a corner of the gather-fitted bedding, with the gathered edge of the bedding wrapped around the bottom lip and the bottom-lip curved-corner portion, with the gathered edge resting on the top or inner surface of the bottom lip and the bottom-lip curved-corner portion, manually pushing the semi-flexible friction-calibrated sheet-material unit and the fitted bedding downward over the bed mattress for installation, or manually pulling upward for removal, using the tab cutouts or the bottom lip as gripping points, where the low-friction inner face of the semi-flexible friction-calibrated sheet-material unit provides smooth downward and upward pushing for installation and removal, and the bottom lip and the bottom-lip curved-corner portion hold the gather-fitted bedding in place underneath the bed mattress during the period between installation and removal.

9 Claims, 4 Drawing Sheets

(56) References Cited

U.S. PATENT DOCUMENTS

| | | | | |
|---|---|---|---|---|
| 5,218,729 | A * | 6/1993 | Walton | A47C 21/022 5/504.1 |
| 7,354,639 | B2 * | 4/2008 | Durney | B21D 5/00 428/122 |
| D573,013 | S | 7/2008 | Lavelle | |
| D624,813 | S | 10/2010 | Lavelle | |
| 8,321,975 | B1 * | 12/2012 | Lindberg | A47C 21/028 5/498 |
| D704,045 | S | 5/2014 | Lavelle | |
| 2016/0198863 | A1 | 7/2016 | Russo | |
| 2017/0119170 | A1 | 5/2017 | Joos | |

* cited by examiner 10
32
22
1
5
40
14
26
24
20
4
2

1
5
30
18
12
28
3
2

32
1
5
24
14
26
4
2

1
5
30
28
3
2

GATHER-FITTED BEDDING PLACEMENT APPARATUS AND METHOD

BACKGROUND

This invention provides a gather-fitted bedding placement apparatus and method for easy installation and removal, and prevention of slippage during use, of gather-fitted bedding such as a fitted sheet or mattress cover or pad upon a bed mattress of standard minimum depth or deeper.

Bedding in the United States and elsewhere includes such items as fitted bedsheets and fitted mattress covers or pads. Such bedding is fitted by gathering the edges, especially at the corners, such that the edges tuck under the mattress and surround the sides of the mattress. A band of elastic is often added to the gathered edges. If the band of elastic is too tight, then the bedding might be difficult to install and remove. If the band of elastic is too loose, then the bedding might not stay in place, but might creep up or even come off during normal use of the bed. After several cycles of washing and drying and of stretching during installation and removal, the elastic is likely to lose its strength and the bedding is likely to shrink, further adding to problems with installation and removal and with staying in place during use.

Although there are known tools for helping with the installation of gather-fitted bedding, such tools do not contribute to keeping the bedding in place during use or to removing the bedding. The known tools are not meant to be left in place between the installed bedding and the mattress in order to keep the bedding in place during use of the bed, and to assist with removal when desired.

The prior art does not provide for a gather-fitted bedding placement apparatus and method for easy installation and removal, and prevention of slippage during use, of gather-fitted bedding such as a fitted sheet or mattress cover or pad upon a bed mattress of standard minimum depth or deeper.

For example, U.S. Pat. No. 4,539,723 was issued to Jerl D. Hillsbery on Sep. 10, 1985, covering "Auxiliary Mattress Corners." The invention covers an accessory article for those liquid-filled bed mattresses commonly marketed as "Waterbeds" and/or "Water Beds." Installation to said liquid-filled beds provides a rigid auxiliary mattress corner, to which a mattress cover and fitted sheet may be attached to remain securely and snugly fitted to the mattresses in normal daily usage. The system may also be attached to conventionally constructed mattresses, such as fiber/spring or polymerics, for the same purpose and result. Specifically, the '723 Patent covers a method for attaching and securing fitted sheets or mattress covers to a mattress, accomplished by placement of a rigid corner forming device, featured at right, beneath and in abutment with each of the side walls of the mattress corners, and securing the corner portions of the fitted sheets or covers respectively around the corner forming devices.

U.S. Pat. No. 4,833,744 issued on May 30, 1989 to David I. Correa for a "Fitted Sheet and Sheet-Holding Fixture for a Waterbed." The '744 Patent discloses a fitted sheet and rigid fixture for holding a corner of a sheet in place on a rectangular waterbed mattress. A fixture is positioned adjacent each corner of the mattress with a base portion under the mattress, an upstanding corner portion having a back side against the corner of the mattress and a face side having a fastener member attached thereto, and a spacing portion spacing the face side from the corner of the frame that holds the waterbed mattress. The fitted sheet has a mating fastener member on the inside surface on each of its corners. In combination, the sheet fits over the mattress and the corner portions of the four fixtures with the fastener members fastened together, holding the sheet in place. Because the corners of the mattress are spaced away from the frame, the mattress does not have to be lifted or otherwise manipulated to position the sheet on, or remove the sheet from, the mattress. The fitted sheet may include a loop or tab attached to the edge of each of its corners. Regarding the "fixture" of the '744 Patent, the fixture includes an upstanding planar corner portion of substantially uniform thickness, where the corner portion is shaped to a quarter round shape with about a 2-inch radius at the center part and flat end parts. The corner portion is connected to the short walls of the base portion by a spacing portion that is integral with both the base portion and the corner portion. The spacing portion is at an angle of about 45-degrees to the base portion and offsets the center portion away from the short walls as viewed from above.

U.S. Publication No. 2016/0198863, published on Jul. 14, 2016 by inventor Scott S. Russo and assignee Russo Inventions, LLC, discloses "Apparatuses and Methods for Placing a Covering About a Mattress." The system provides an apparatus and method for manipulating a covering, such as a bed sheet. The apparatus, in one form, includes a proximal grip portion and a distal covering engaging portion with a plurality of spaced-apart protrusions for engaging with corresponding spaced-apart openings in the covering. The apparatus includes end stop portions adjacent to the protrusions for limiting how far the protrusions may extend through the openings in the covering. A tool receiving portion of the covering may take the form of a pocket or spaced-apart openings that are located in at least one corner portion of the cover. The installation tool engages with the openings in the covering to manipulate the cover and reduces the need to bend over or crouch down to reach around or underneath the mattress when placing the sheet about the mattress.

U.S. Pat. No. 5,218,729, issued on Jun. 15, 1993 to Donald L. Walton, discloses a "Bed Sheet Clamping Holder." The holder includes a device for holding a fitted sheet to a mattress, and is provided with a base portion upon which a corner of a mattress is to be positioned, a rail attached to the base for positioning the device respective to the mattress, and clamps connected to the rail and base to grip the edges of the sheet. In the claimed system, the rail member and clamp are integrally molded plastic rigidly connected to the base portion and extend perpendicular from the base portion to form a tray-like holder with the base portion. The rail member has a rounded corner, into which the rounded corner of a mattress may be positioned. The clamps include a rear gripping member connected to the base portion and to the ends of the rail member, a front gripping member, and a plastic hinge that connects the rear member and the front member together at one edge. The clamps are attached to the flat base with the plastic hinge located in substantially the same plane as the base. The holder further includes a spring clip positioned over the hinge and held slidably by the rear gripping member, where the spring clip is movable between a closed position and an open position for biasing the front gripping member together with the rigid rear gripping member when in the closed position.

U.S. Publication No. 2017/0119170 was published on May 4, 2017 by Patricia Jane Joos, disclosing a "Tool for Installing Fitted Bed Sheets." The Joos tool is an apparatus that facilitates the wrapping of a bed sheet around a corner of a mattress with minimal effort. The apparatus serves as an extension of the user's hand and applies the necessary force onto the elastic band of the bed sheet in the correct direction.

The apparatus includes a handle, a sheet-corner brace, a first anchor, a second anchor, a sheet-pressing panel, and a tucking lip. The tucking lip is connected adjacent to the first brace end of the sheet-corner brace, and the sheet-pressing panel is connected adjacent to the second brace end of the sheet-corner brace. The handle is connected onto the sheet-pressing panel, opposite to the sheet-corner brace, and the first anchor is connected adjacent to the sheet-corner brace. The second anchor is connected adjacent to the sheet-corner brace, opposite to the first anchor. The Joos tool was developed to assist an individual in the physical process of installing a bed sheet onto a mattress and was designed to eliminate the need to bend down when installing the bed sheet. In use, the individual can simply place the tool into the corner of the sheet and push the tool vertically downward along the exterior corner of the mattress. In doing so, the corner of the sheet rides along the tool as the elastic band of the sheet is pushed along the mattress corner and snaps into place once the tool head reaches the base of the mattress. The elongated handle of the tool eliminates the need to bend down to fit the tool over the mattress corner, and the contour of the tool head facilitates in accurately placing the corner of the sheet over the corner of the mattress.

U.S. Design Pat. No. D573,013, was issued on Jul. 15, 2008 to inventor Richard M. Lavelle for a "Corner Protector."

U.S. Design Pat. No. D624,813 was issued on Oct. 5, 2010 to inventor Richard M. Lavelle for a "Corner Protector."

U.S. Design Pat. No. D704,045 was issued on May 6, 2014 to inventor Richard M. Lavelle for a "Corner Protector."

An apparatus and method are needed for easy installation and removal, and prevention of slippage during use, of gather-fitted bedding such as a fitted sheet or mattress cover or pad upon a bed mattress of standard minimum depth or deeper.

SUMMARY OF THE INVENTION

This invention provides a gather-fitted bedding placement apparatus and method for easy installation and removal, and prevention of slippage during use, of gather-fitted bedding such as a fitted sheet or mattress cover or pad upon a bed mattress of standard minimum depth or deeper.

The gather-fitted bedding placement apparatus has a semi-flexible friction-calibrated sheet-material unit of a size corresponding to the standard minimum depth of the bed mattress, a bottom lip formed along the bottom edge of the semi-flexible friction-calibrated sheet-material unit, at least one curve-enabling notch in the central portion of the bottom lip, to enable bending of the semi-flexible friction-calibrated sheet-material unit to conform to the corner of the mattress, a bottom-lip curved-corner portion formed by such bending, and at least one tab cutout through the semi-flexible friction-calibrated sheet-material unit.

The method is practiced by using a gather-fitted bedding placement apparatus at each corner of the mattress, placing the bent semi-flexible friction-calibrated sheet-material unit underneath and inside of a corner of the gather-fitted bedding, with the gathered edge of the bedding wrapped around the bottom lip and the bottom-lip curved-corner portion, with the gathered edge resting on the top or inner surface of the bottom lip and the bottom-lip curved-corner portion, manually pushing the semi-flexible friction-calibrated sheet-material unit and the fitted bedding downward over the bed mattress for installation, or manually pulling upward for removal, using the tab cutouts or the bottom lip as gripping points, where the low-friction inner face of the semi-flexible friction-calibrated sheet-material unit provides smooth downward and upward pushing for installation and removal, and the bottom lip and the bottom-lip curved-corner portion hold the gather-fitted bedding in place underneath the bed mattress during the period between installation and removal.

BRIEF DESCRIPTION OF DRAWINGS

Reference will now be made to the drawings, wherein like parts are designated by like numerals, and wherein.

DETAILED DESCRIPTION OF THE INVENTION

Figures 1A, 1B, 1C, 1D:
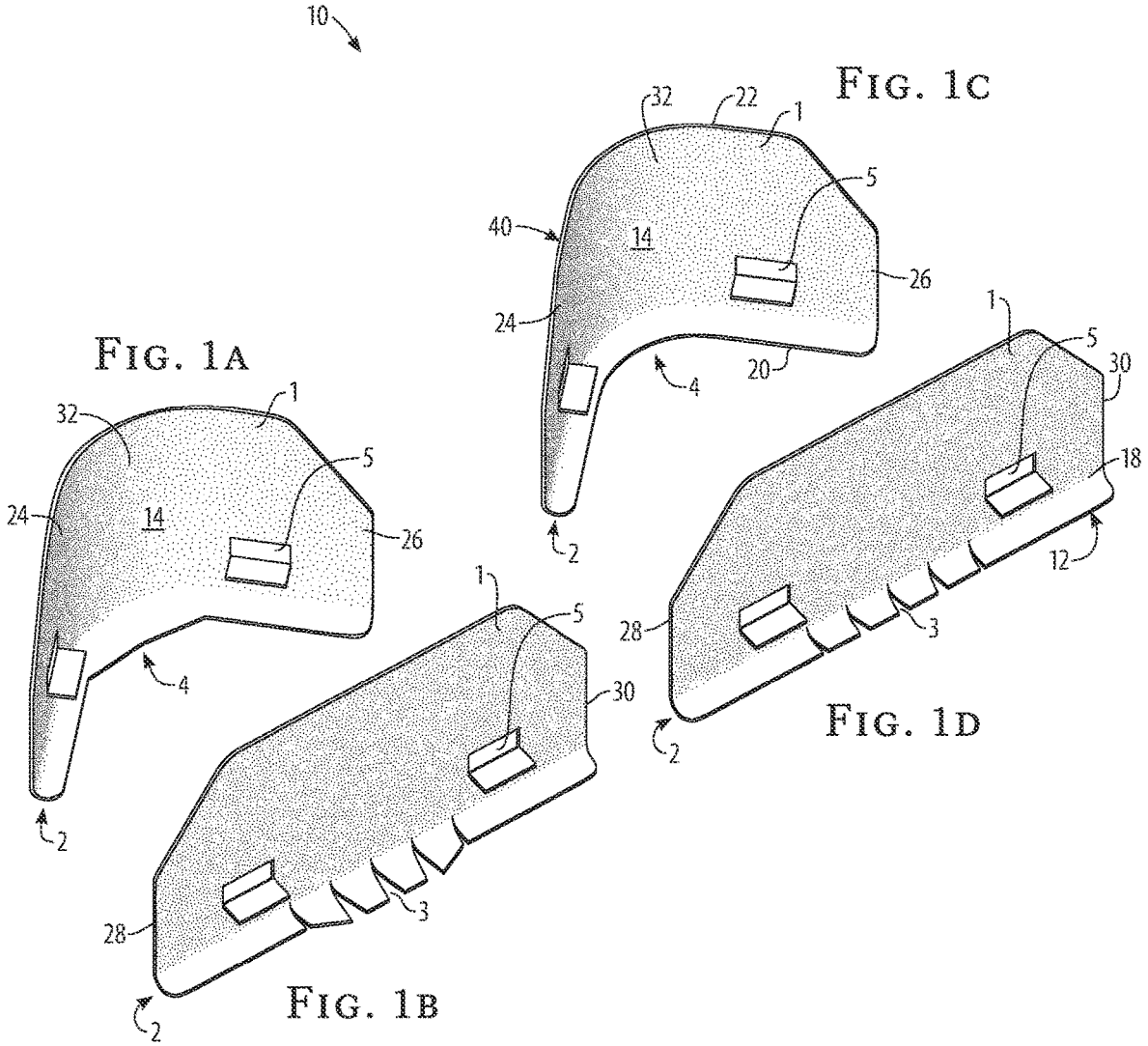
FIG. 1*a* is a perspective view of an exemplary embodiment of the gather-fitted bedding placement apparatus of the invention.
FIG. 1*b* illustrates one of exemplary methods of forming the apparatus of the present invention.
FIG. 1*c* is a perspective view of another exemplary embodiment of the apparatus of the present invention.
FIG. 1*d* illustrates another exemplary method of forming the apparatus of the present invention.

Referring to FIGS. 1*a-d* and all of the figures generally, the gather-fitted bedding placement apparatus 10 and method of the invention is shown. The typical bed mattress has four corners, so typically the method uses four semi-flexible friction-calibrated sheet-material units 1. Each unit is made from a semi-flexible sheet material 12 such as high-density polyethylene (HDPE) or a similar material. In use, the semi-flexible friction-calibrated sheet-material unit 1 will curve around the corner of the bed mattress, and will have an inner face or low-friction inner surface 14 toward the mattress and an outer face 16 opposite, and will have a bottom with a lower boundary 18, a top edge 22, side portions 24, 26, with corresponding outer edges 28, 30, respectively, and a central portion 32, which is adapted to conform to a corner of a conventional mattress having a predetermined depth. The pair of side portions 24, 26 extend from opposite sides of the central portion 32 in a substantially right-angle relationship to each other. Optimally, there will be no sharp corners prone to snagging, but gentle curves along the edges. The material should be flexible enough to allow formation of a radius-curved corner substantially matching that of the bed mattress.

Figure 2:
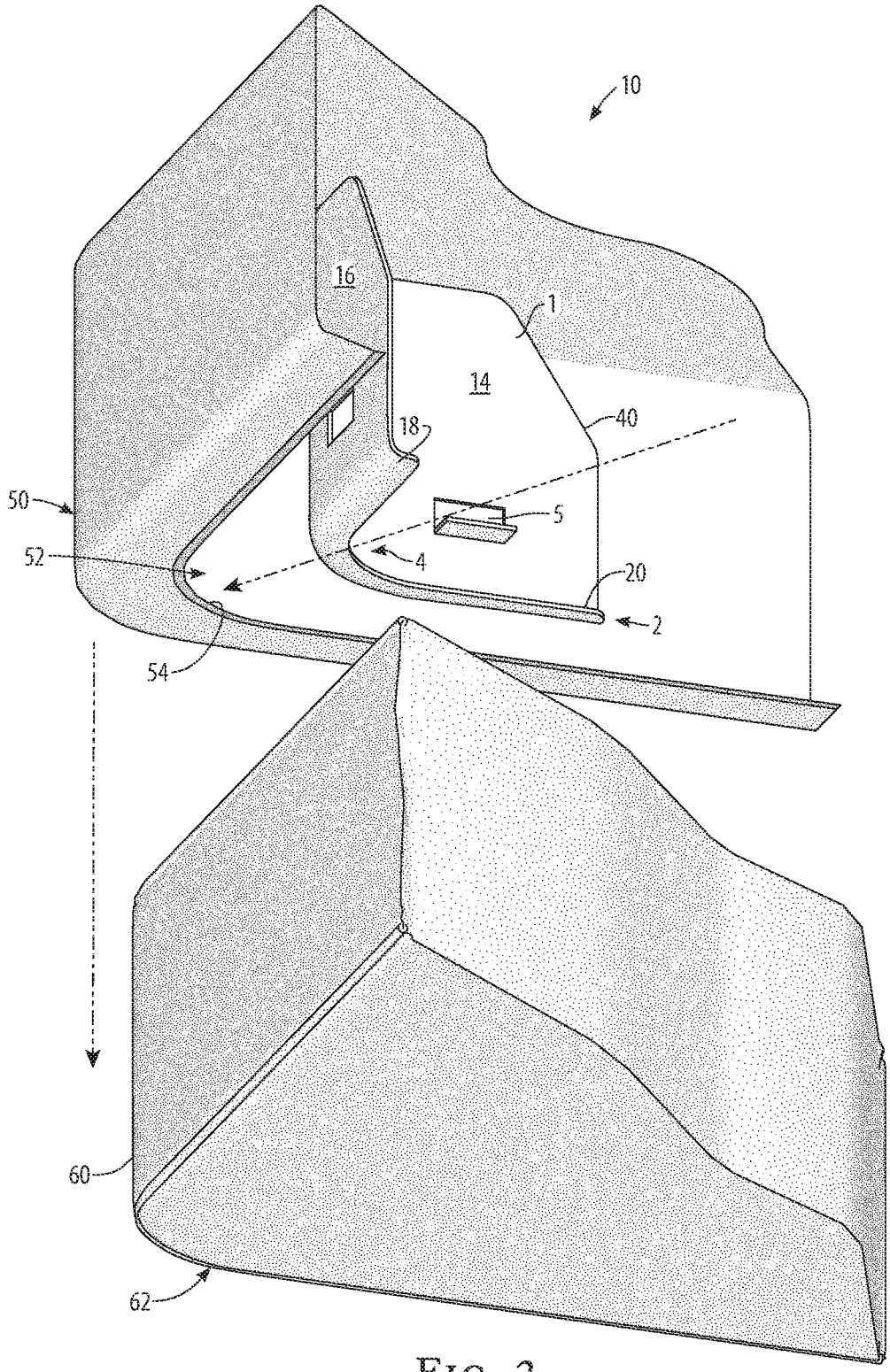
FIG. 2 is a cutaway schematic view of the use of the gather-fitted bedding placement apparatus of the invention.

A bottom lip 2 is formed on the semi-flexible friction-calibrated sheet-material unit 1 by bending the bottom of the unit 1 along the lower boundary 18 line into a substantially perpendicular position. As can be seen in FIG. 2, once the unit 1 is formed, the body thereof defines a main body portion 40, which is configured to conform to a corner of a bed mattress, and the unitary bottom lip 2, which follows the configuration of the main portion 40 and extends along entire length thereof. The outermost edge 20 of the lip 2 follows the configuration of the central portion 32 and the side portions 24, 26. Optimally, the semi-flexible sheet material will not be so flexible as to fail to retain this bend for the bottom lip 2. Ways of achieving the desired semi-flexiblilty are to set the bend for the bottom lip 2 using heat, bolster the bend with additional material, and scoring portions of the material to allow bending.

The bend formed in the central portion 32 and in the lip 2 to conform to the mattress and the bend 4 in the bottom lip 2 are perpendicular each to the other, so the bends will resist each other. One or more curve-enabling notches 3 are therefore placed into the bottom lip 2 to allow the semi-flexible friction-calibrated sheet-material unit 1 to be bent into conformation with the mattress corner without pushing out the bend forming the bottom lip 2. In use, with the semi-flexible friction-calibrated sheet-material unit 1 bent into a curve conforming to the corner of the mattress, a bottom-lip curved-corner portion 4 will be formed. The central portion of the bottom lip 2 can be made elongated, and in use the bottom-lip curved-corner portion 4 will have more surface area to contact the underside of the mattress.

One or more tab cutouts 5 are made through the semi-flexible friction-calibrated sheet-material unit 1 in order to provide a surface on which to push or pull vertically for installation or removal.

In a preferred embodiment, the inner face 14 of the semi-flexible friction-calibrated sheet-material unit 1 is given a smooth, low-friction surface finish to promote the sliding of the unit on the mattress corner 60, and the outer face 16 is given a less-smooth surface finish in order to lessen any sliding of the gather-fitted bedding 50 along the outer face 16.

Referring to FIG. 2, in use, the semi-flexible friction-calibrated sheet-material unit 1 is placed into the corner pocket 52 of the gather-fitted bedding 50, and the gathered edge 54 of the bedding is curved around and rests on top of the bottom lip 2 and the bottom-lip curved-corner portion 4. Then the semi-flexible friction-calibrated sheet-material unit 1 and the bedding 50, together, are pushed downward upon the corner 60 of the mattress 62. By pressing the fingers or thumbs against the bedding fabric and into the tab cutouts 5, a better grip for pushing can be made. Alternatively, the bedding and the bottom lip 2 can be gripped and pushed or pulled.

Figure 3:
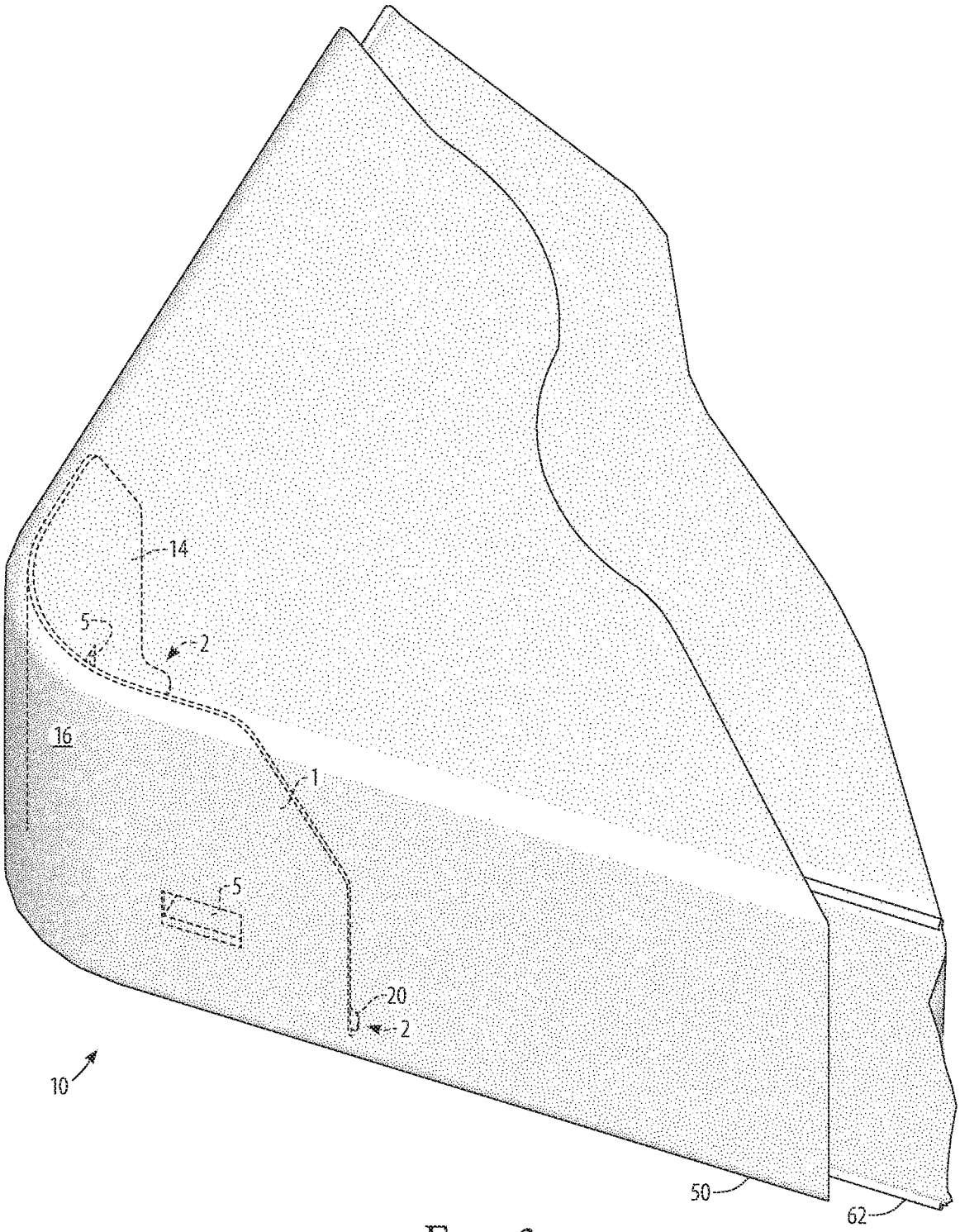
FIG. 3 is a hidden-line topside view of the gather-fitted bedding placement apparatus of the invention in use.
Figure 4:
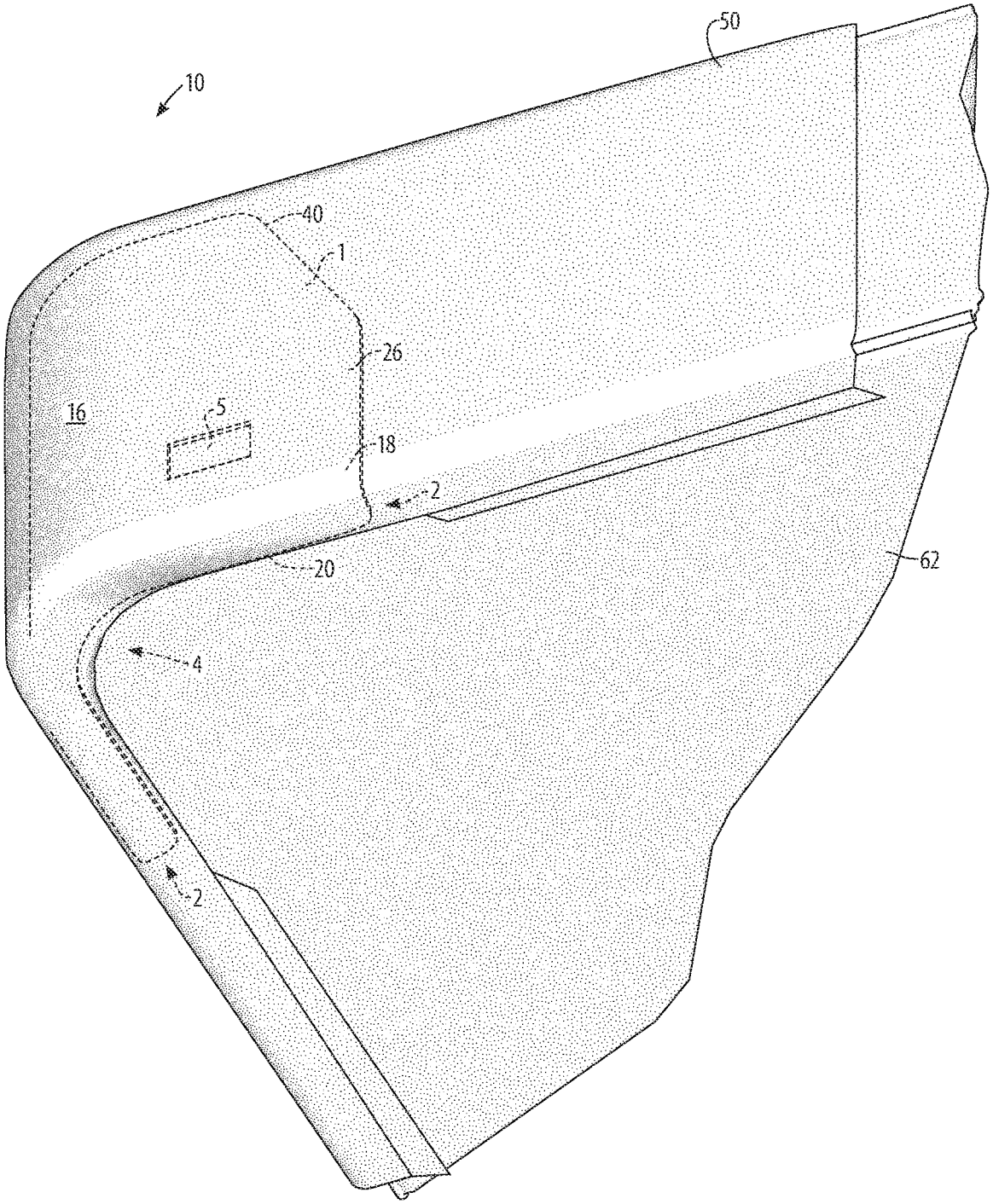
FIG. 4 is a hidden-line underside view of the gather-fitted bedding placement apparatus of the invention in use.

Referring to FIG. 3 and FIG. 4, in use, after installation of the gather-fitted bedding upon the bed mattress, the semi-flexible friction-calibrated sheet-material unit 1 is left in place between the bedding and the mattress, with the gathered edge of the bedding curled around and sitting between the top of the bottom lip 2 and the bottom-lip curved-corner portion 4, and the mattress. This positioning keeps the fitted bedding from creeping up or coming off of the bed mattress when removal is not intended.

Removal of the fitted bedding is achieved by pulling the semi-flexible friction-calibrated sheet-material unit 1, and the bedding, upward. The tab cutouts 5 can provide a gripping surface for removal.

Many other changes and modifications can be made in the apparatus and method of the present invention without departing from the spirit thereof. I therefore pray that my rights to the present invention be limited only by the scope of the appended claims.

I claim:

1. A gather-fitted bedding placement apparatus configured to facilitate installation and removal, and prevention of slippage during use, of gather-fitted bedding for a bed mattress of a predetermined depth, the gather-fitted bedding placement apparatus comprising:

(i) a semi-flexible friction-calibrated sheet-material unit of a size corresponding to the predetermined depth of the bed mattress and forming a main body portion, the main body portion having an inner face configured to contact the bed mattress, said inner face having a low-friction surface, an opposite outer face configured to contact the gather-fitted bedding, a lower boundary, a curved central portion, having a configuration conforming to a corner of the bed mattress, and a pair of side portions extending from opposite sides of the central portion;

(ii) a bottom lip formed along said lower boundary, said bottom lip extending substantially perpendicularly from said inner face and being provided with an outermost lip edge which follows a curved configuration of the lower boundary, said bottom lip being adapted to fit underneath the bed mattress in use;

(iii) at least one tab cutout formed in the side portion, adapted to provide gripping surface for installation and removal; where, said side portions extend in a substantially right-angle relationship to each other; said unit is configured to fit into a corner of the gather-fitted bedding and to be installed on the corner of the bed mattress while the gather-fitted bedding is positioned on the bed mattress; and where said bottom lip is configured to hold the gather-fitted bedding in place underneath the bed mattress during the period between installation and removal.

2. The gather-fitted bedding placement apparatus of claim 1, where said outer face of the unit has a rough-textured surface adapted to prevent slippage of the gather-fitted bedding.

3. The gather-fitted bedding placement apparatus of claim 1, where said semi-flexible friction-calibrated sheet-material unit is made of a thermoplastic sheet material.

4. The gather-fitted bedding placement apparatus of claim 1, where said semi-flexible friction-calibrated sheet-material unit is made of High-Density Polyethylene (HDPE).

5. The gather-fitted bedding placement apparatus of claim 1, where said bottom lip is formed by bending while heated.

6. The gather-fitted bedding placement apparatus of claim 1, where said bottom lip comprises a plurality of score notches to facilitate bending of said bottom lip.

7. The gather-fitted bedding placement apparatus of claim 1, where the central portion of said bottom lip is elongated in order to form said bottom-lip curved-corner portion.

8. The gather-fitted bedding placement apparatus of claim 1, further comprising more than one curve-enabling notch.

9. The gather-fitted bedding placement apparatus of claim 1, where one tab cutout is formed in each side portion of said unit.

* * * * *